United States Patent [19]

Hiroshima et al.

[11] Patent Number: 4,676,693

[45] Date of Patent: Jun. 30, 1987

[54] METHOD OF CONFIRMING POSITION OF DRAIN MATERIAL LEFT AND APPARATUS FOR CONFIRMING SAME IN DRAIN ENGINEERING METHOD

[75] Inventors: Toshio Hiroshima, Sayama; Mamoru Tamura, Urayasu; Mikio Sakaizumi, Tokyo, all of Japan

[73] Assignees: S: Kajima Corporation; Fudo Construction Co., Ltd.; Nitsushin Soil Consulting Corporation, all of Japan

[21] Appl. No.: 677,089

[22] Filed: Nov. 30, 1984

[51] Int. Cl.[4] ..... E02D 3/10; G01N 27/72

[52] U.S. Cl. ..... 405/50; 405/36; 324/226

[58] Field of Search ..... 405/36–38, 405/43, 45, 50, 160, 175, 181, 232, 240–242, 245, 258, 270; 173/20, 21; 166/255; 324/207, 208, 221, 226

[56] References Cited

U.S. PATENT DOCUMENTS

| | | | |
|---|---|---|---|
| 3,772,892 | 11/1973 | Ogawa | 405/258 |
| 4,066,962 | 1/1978 | Jaffe | 324/208 |
| 4,394,577 | 7/1983 | Peterson et al. | 173/21 X |
| 4,428,699 | 1/1984 | Juhola | 405/36 X |
| 4,449,848 | 5/1984 | Juhola | 405/50 |
| 4,455,105 | 6/1984 | Juhola | 405/36 X |
| 4,492,492 | 1/1985 | Izawa et al. | 405/175 X |

FOREIGN PATENT DOCUMENTS

| | | | |
|---|---|---|---|
| 33632 | 2/1983 | Japan | 405/50 |
| 703631 | 12/1979 | U.S.S.R. | 405/181 |
| 1002459 | 3/1983 | U.S.S.R. | 173/21 |

*Primary Examiner*—Cornelius J. Husar
*Assistant Examiner*—Nancy J. Stodola
*Attorney, Agent, or Firm*—James H. Tilberry

[57] ABSTRACT

A method and apparatus is provided to embed paper drain material in water-laden soil by means of a mandrel driven into the soil by power means. The paper drain material is intermittently treated with a substance detectable by a signal emitted electronic sensing means secured to the lower end of the mandrel. When the paper drain is believed to be in place, the mandrel is withdrawn. During mandrel withdrawal, as each sensing means passes by each detectable substance, the signal from the sensing means is modulated, thereby indicating that the paper drain is embedded in place and the mandrel has disengaged from the paper drain. If the paper drain adheres to the mandrel and is being withdrawn with the mandrel, no modulated signal will be generated, thereby indicating that the paper drain is not properly anchored in the soil. By varying the physical properties of the detectable substances, the signal from each substance can be made unique, thereby enabling the operator to determine the relative position of the mandrel to the paper drain.

13 Claims, 12 Drawing Figures

METHOD OF CONFIRMING POSITION OF DRAIN MATERIAL LEFT AND APPARATUS FOR CONFIRMING SAME IN DRAIN ENGINEERING METHOD

FIELD OF THE INVENTION

This invention relates to the method of stabilizing water-saturated soil by vertical draining such as disclosed and described in U.S. Pat. No. 4,428,699 entitled "Procedure And Means For Providing A Vertical Drain In The Bottom Of A Water Body." Specifically, the invention relates to a method and apparatus for determining if a vertical drain has been properly embedded to the desired depth in the soil to be drained.

BACKGROUND OF THE INVENTION

In prior art vertical drain methods, paper drain materials are embedded vertically into the ground by embedding means such as a mandrel and then the mandrel is withdrawn. The lower end of the drain is usually provided with an anchor so that once the vertical drain has been properly positioned depthwise, the lower end of the vertical drain is anchored at the desired soil depth, thereby enabling the mandrel to be withdrawn without disturbing the vertical drain. However, for various reasons, such as mandrel contamination, soil pressure and/or water pressure, the drain sometimes does not become anchored as intended but instead adheres to and follows the mandrel upwardly as it is withdrawn from the soil, When this occurs and is detected, it is necessary to reposition the drain. Unfortunately, it is not always possible to know if a drain is improperly positioned since it may follow the mandrel upwardly for some distance and then become disengaged, leaving the drain embedded out of sight but not at the desired depth or vertical alignment.

SUMMARY OF THE INVENTION

The present invention has been conceived and designed to deal with the problem of misplaced and misaligned vertical drains. In particular, the present invention provides a method and apparatus for determining if a vertical drain, once properly embedded, remains in proper position or is disturbed and vertically misaligned during withdrawal of the mandrel. This is accomplished by the use of specially treated drain paper to which detectable substances or materials, such as metal plates, are affixed to the drain paper longitudinally at regular predetermined intervals throughout the length of the drain paper. A sensor is mounted on or within the lower end of the driving mandrel and is adapted to sense the presence of the detectable substances. After the paper drain has been anchored and the mandrel is being withdrawn, as the sensor passes each detectable substance, a signal is generated, processed, and recorded to inform the operator whether the drain has remained in place, or whether it has been vertically dislodged and to what extent.

OBJECTS OF THE INVENTION

It is therefore among the objects of the invention to provide a method and apparatus to detect vertical misalignment of a paper drain embedded in soil to be vertically drained; to provide means for detecting vertical displacement of a paper drain during withdrawal of the drain embedding mandrel; to provide specially prepared paper drain material having detectable means embedded therein or secured thereto; to provide paper drain detectable means which are spaced apart predetermined distances along the longitudinal axis of the paper drain material; to provide a sensor secured to the paper drain embedding mandrel adapted to sequentially detect said detectable means and to generate signals responsive to said detection; and to provide means to receive, monitor, process, and record said sensor signals.

Other and further objects, features, and advantages of the present invention will be readily apparent to those skilled in the art when the following description of the preferred embodiments is read in conjunction with the accompanying drawings, in which:

FIG. 3(*b*) is a fragmentary, schematic, elevational view of the lower ends of the mandrel and paper drain showing the paper drain fully embedded and anchored and the mandrel in the process of being withdrawn;

FIG. 3(*c*) is a fragmentary, schematic, elevational view of the lower ends of the mandrel and paper drain showing the paper drain fully embedded and anchored and the mandrel substantially withdrawn;

DESCRIPTION OF PREFERRED EMBODIMENTS OF THE INVENTION

Figure 1:
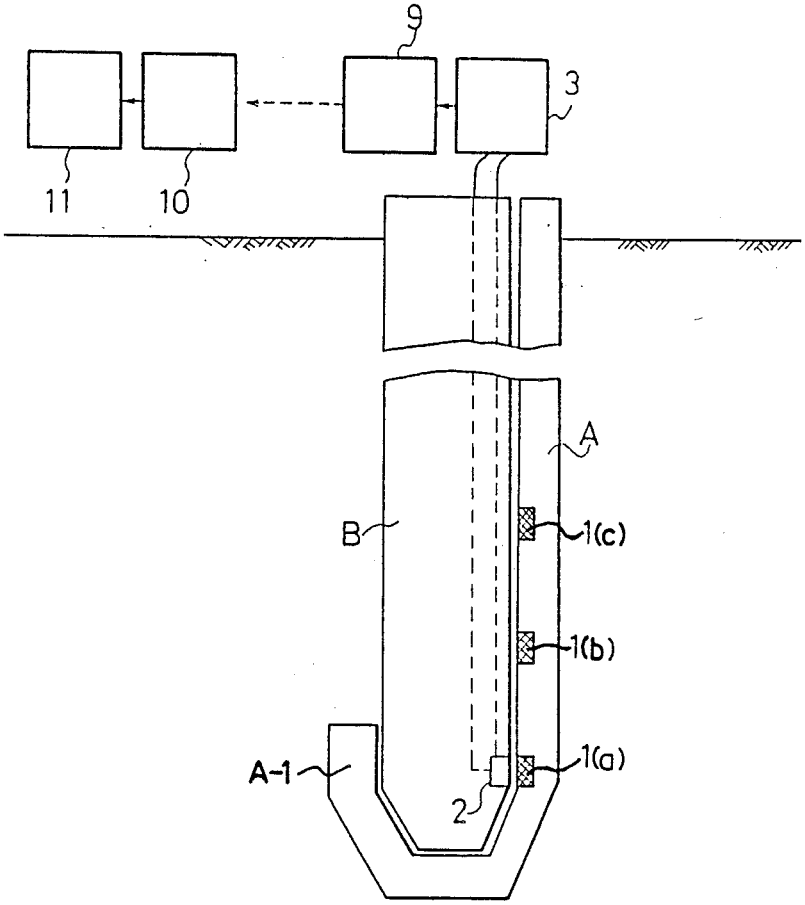
FIG. 1 is a schematic, elevational view of one preferred embodiment of the invention.
Figure 2:
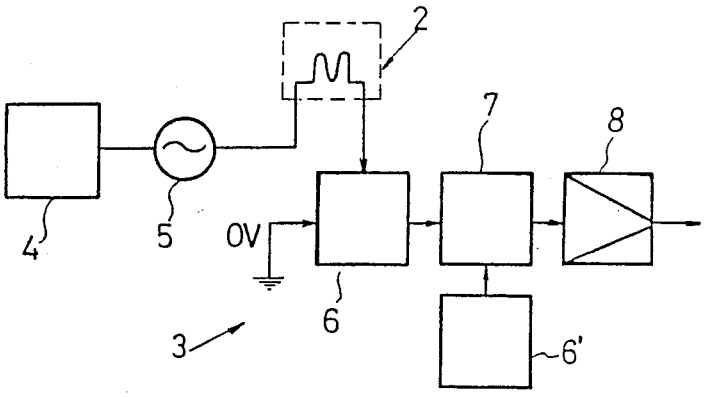
FIG. 2 is a schematic block diagram of a portion of one preferred embodiment of the sensing means comprising a portion of the invention.

Referring first to FIG. 1, there is shown a paper drain A, the lower end of which is wrapped around the lower end of a mandrel B and hooked upwardly to form an anchor A-1. Sensor detectable means 1(*a*)(*b*)(*c*) have been applied to the paper drain at predetermined intervals along the length of the paper drain. A sensor 2, adapted to sense detectable means 1(*a*)(*b*)(*c*), is secured to the lower end of mandrel B and wired to oscillator 3, more completely shown in FIG. 2. Oscillator 3 comprises a power supply 4 connected to an oscillator 5 which generates and transmits a high frequency current to the sensor 2.

The high frequency current flowing through the sensor 2 changes as its impedance changes when the sensor 2 approaches the detectable means 1(*a*)(*b*)(*c*). Thus, the input signal to a level detector 6 is changed so that the signal level deviation is larger than a detection value preset by a detection level setter 6' in a comparator 7 and a signal is generated as the output signal detecting the detectable means 1(*a*)(*b*)(*c*). The output signal from the comparator 7, amplified up to the appropriate degree for monitoring wave form by an amplifier 8, is sent to a transmitter 9 and further transmitted from the transmitter 9 to a reveiver 10 to be recorded by a data recorder 11.

Figure 3:
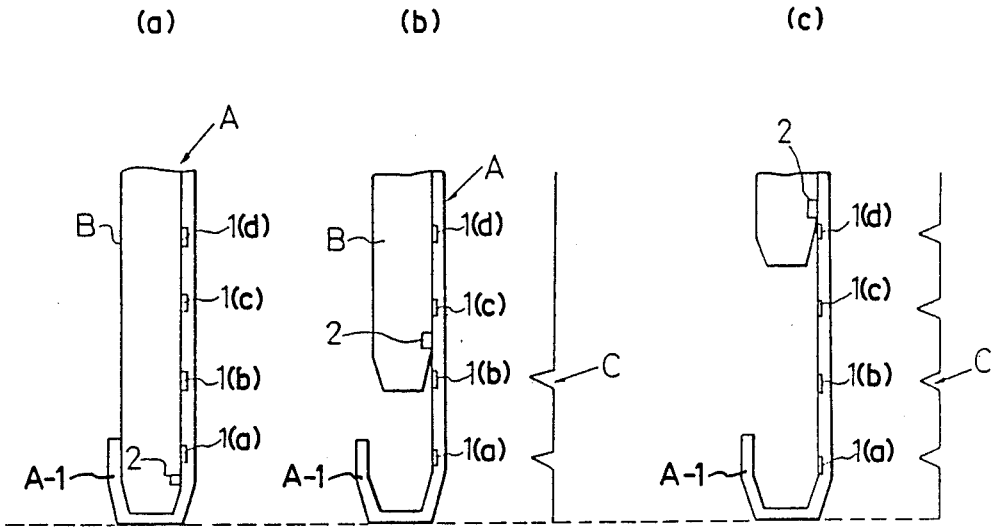
FIG. 3(*a*) is a fragmentary, schematic elevational view of the lower ends of the mandrel and paper drain fully embedded in water-saturated soil.

FIG. 3(*a*) shows the proper relation between a paper drain A and a mandrel B at the fully embedded position of paper drain A. If the paper drain is properly embedded and anchored with anchor hook A-1, upon withdrawal of mandrel B as shown in FIG. 3(*b*), pulses C are generated as sensor 2 moves vertically upward past the lower two detectable means 1(*a*) and 1(*b*). These signals indicate that the lower end of the mandrel B has separated from the lower end of the paper drain, leaving the paper drain anchored in place by anchor hook A-1 at its predetermined depth. As the mandrel continues its upward movement, additional pulses C are generated, as shown in FIG. 3(*c*), when the sensor 2 passes detectable means 1(*c*) and 1(*d*), indicating that the mandrel is not disturbing the placement of the paper drain A during its withdrawal.

Should the paper drain A initially cling to the mandrel B during mandrel withdrawal, then no pulses C will be generated and the operator will be alerted to this condition, whereupon remedial action may be taken. Furthermore, should the mandrel B snag the paper drain A after mandrel withdrawal is underway, the location of the snag may be determined if the shapes of the pulses are varied in a predetermined and known manner by appropriate modification of the detectable means. With various shaped pulses, it is possible to determine the place on the paper drain at which the snag occurred.

Figure 4:
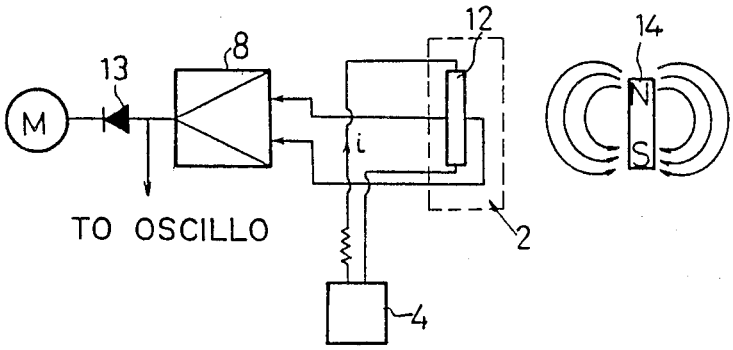
FIG. 4 is a schematic block diagram showing a magnetic sensor system used in accordance with one preferred embodiment of the invention.

FIG. 4 shows a magnetic sensor employed in place of the oscillator in the prior embodiment. A Hall element 12 is used as the sensor and magnetized metal plates 14 are used as the detectable means. Proper operating voltage is applied to the Hall element 12 from the power supply 4. When this Hall element 12 approaches the metal plate 14 to receive lines of magnetic force, the output voltage from the Hall element 12 to the amplifier 8 is changed. The signal amplified by the amplifier 8 is displayed on an indicator M through a diode 13, while the wave form of the output from the amplifier 8 may be confirmed by an oscilloscope or the like, not shown but well understood by those skilled in the art.

Figure 5:
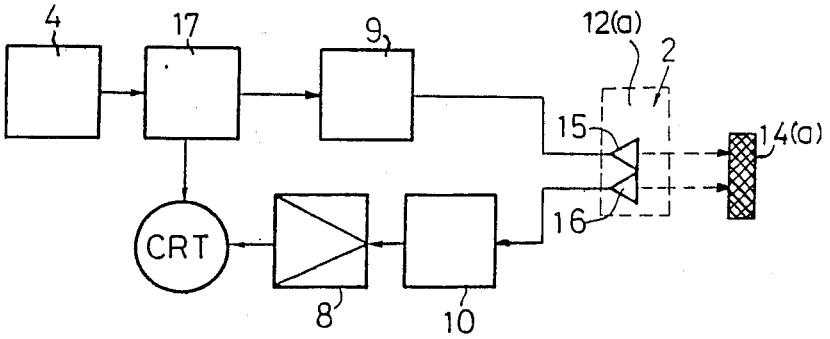
FIG. 5 is a schematic block diagram showing a supersonic sensor system used in accordance with another preferred embodiment of the invention.

An embodiment employing a supersonic system sensor is shown in FIG. 5 wherein there is arranged a supersonic reflector 14(*a*) or absorber for the detectable means, a supersonic projector 15 and a wave receiver 16 for the sensor means 12(*a*). As shown in the block diagram of FIG. 5, a transmitter 9 generates high frequency according to the signal from a synchronizer 17 connected to the power supply 4, and a supersonic wave is projected from the projector 15 to the wave receiver 16. This supersonic wave reaches the wave receiver 16 with a reflection factor higher than that of other portions of the drain material (in the case of reflector) or under the attenuated condition (in the case of absorber) according to the physical properties of the means 14(*a*) to be detected and then passes through the receiver 10 to be amplified by the amplifier 8. The wave form of the output signal from the amplifier 8 is displayed on an indicator CRT together with the sweep voltage from the synchronizer 17. Further, in the embodiments of FIGS. 4 and 5, the wave may be transmitted from the transmitter to be recorded in a remote data recorder.

Figure 6:
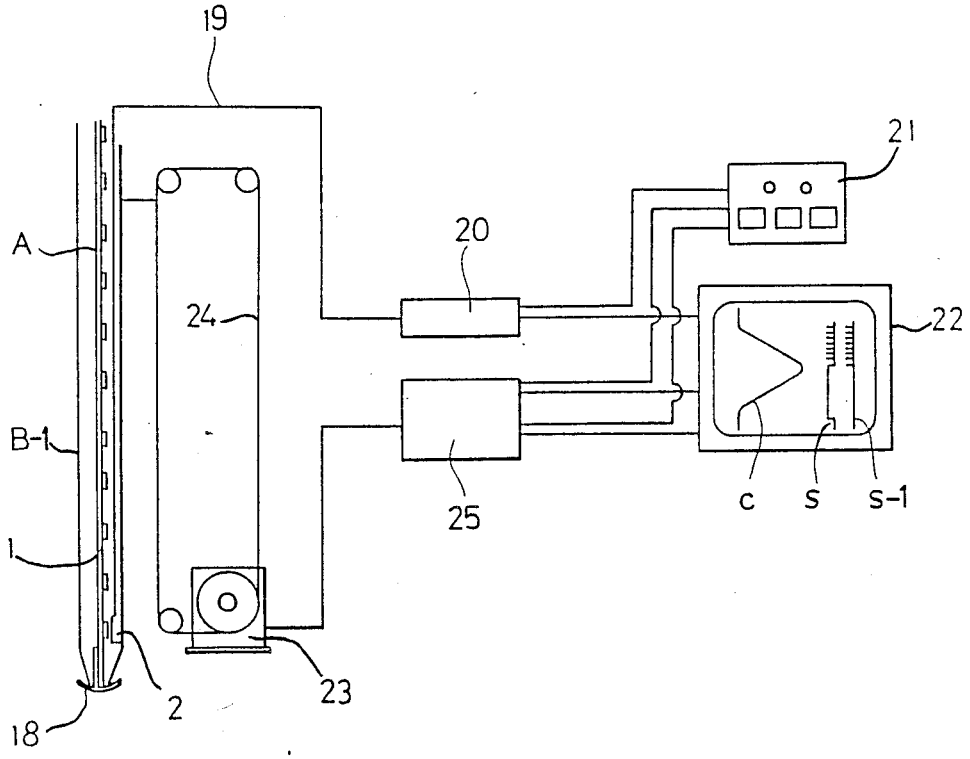
FIG. 6 is an embodiment of the invention showing another preferred embodiment of the drain embedding mandrel and sensor system.

Referring now to FIG. 6, mandrel B-1 is a hollow pipe slidably supported by a well-known leader (not shown) and driven into and drawn out of the ground by a well-known penetrator.

The paper drain material A is inserted in the mandrel B-1 and at the lower end of the mandrel B-1 is interconnected an anchor 18 inserted in the end of the mandrel B-1 and the lower end of the paper drain material A. On said drain material A are mounted the means 1 to be detected, such as magnets, at certain intervals and the sensor 2, such as a magnetic sensor, is secured fixedly to the inner wall surface near the lower end of the mandrel B-1. The signal from the sensor 2 is transmitted to the upper end of the mandrel B-1 through a cable 19 and then to the inputs of a monitor 21 and a recorder 22 through a controller 20 to indicate the signal in the monitor 21 by an indicator such as lamp, meter, oscilloscope or the like. Also, in the recorder 22 is recorded the signal S by a pen graph or the like.

A combined depth detecting and reference signal generating unit 23 is provided in addition to the monitor and recorder 21,22. This unit 23 is synchronized for rotational movement by an endless belt 24 connected to a portion of the mandrel B-1. The depth of the mandrel B-1 is detected by the rotational frequency of unit 23 and linear direction of the mandrel. The signal is set to the inputs of the monitor 21 and the recorder 22 through a converter 25. Also, unit 23 provides the reference signal generator to generate the reference signal S-1 corresponding to the withdrawal distance of the mandrel B-1. This signal is set to the inputs of the monitor 21 and the recorder through the converter 25 in the same way as said depth signal. However, if the record of the depth is not needed, the combined depth detecting and signal generating unit 23 may be a single reference signal generator which is interlocked with the endless belt 24.

Figure 7:
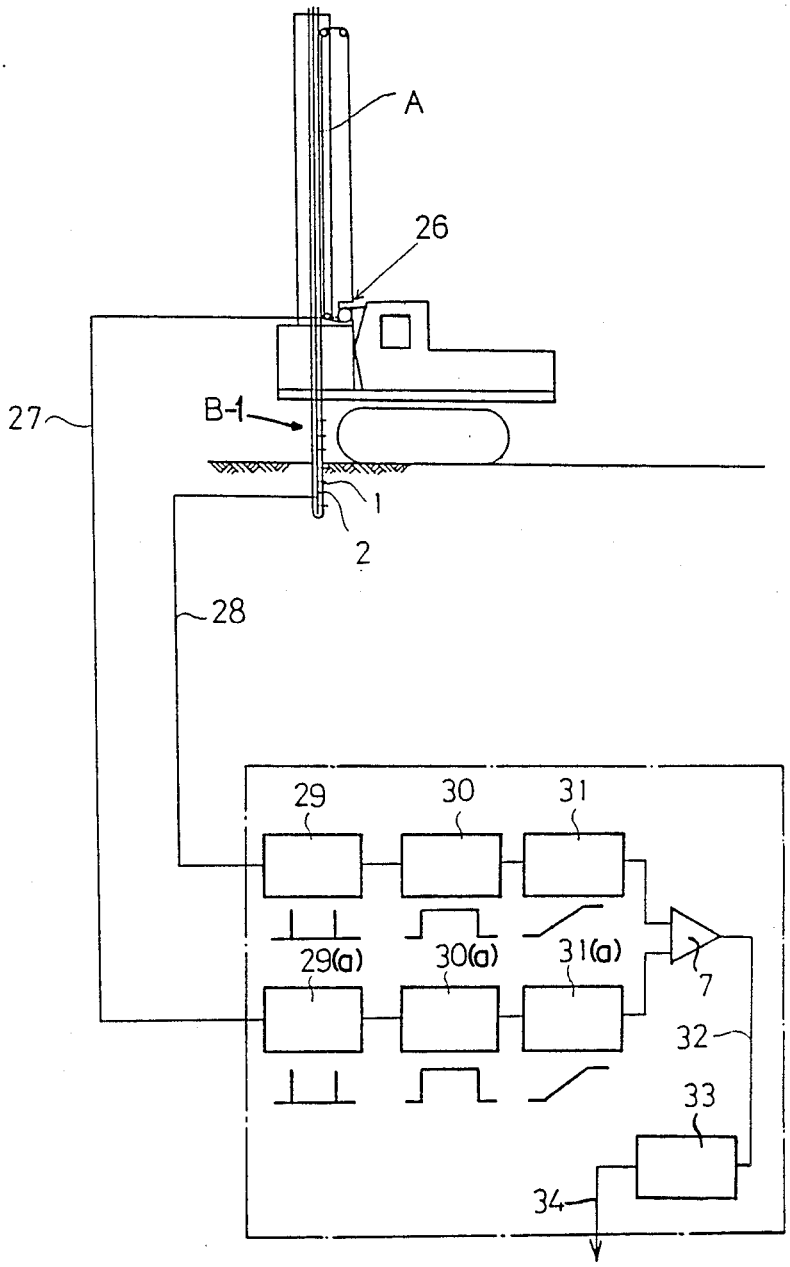
FIG. 7 is an embodiment of the invention showing yet another preferred embodiment of the drain embedding mandrel and sensor system.

Referring to FIG. 7, there is shown the means for detecting the co-rise of the drain material A with the mandrel B. In this drawing, symbol B-1 designates a driving jig such as the mandrel which is driven into the ground together with the paper drain material A. Further, the detector 2 is mounted on the end of the driving mandrel B-1, and a plurality of metal bodies 1 to be detected by said detector 2 are provided in a predetermined interval longitudinally on the paper drain material A. Symbol 26 designates a driving depth indicator which is constituted to detect the driving depth of the end of driving mandrel B-1 in the execution and display of said depth on a recorder through a converter (not shown). Also, after the driving mandrel B-1 is driven to a predetermined depth, the driving depth indicator 26 is provided to detect the end position of driving mandrel B-1 per the unit length of withdrawal with reference to said depth and generate the output as the driving reference pulse signal through a converter (not shown). While the paper drain material A is secured to the driving mandrel B-1 and the driving mandrel B-1 is withdrawn after the completion of driving it to the predetermined depth, said drain material A may co-rise, which is not preferable in the drain engineering method. Thus, when the driving mandrel B-1 is withdrawn, the location of the embedded drain material A is sensed through a plurality of materials 1 adapted to be detected when positioned and fixed on the drain material A.

The driving reference pulse signal 27 and the left depth pulse signal 28 are differentiated by a differentiating circuit 29,29(*a*) so that the pulses are wave shaped. Next, both wave shaped pulse signals 27,28, as trigger signals, are sent to the input of flip-flop circuits 30, 30(*a*) to produce rectangular waves having the same level. Then the rectangular waves of the respective signals 27,28 are time-integrated by integrating circuits 31,31(*a*) to obtain voltage level proportional to pulse interval time. Respective voltage level signals are sent to the input of the comparator 7, which is adapted to compare both signals, while assuming the co-rise of the drain material A, when the interval of the left depth pulse signal 28 is larger than that of the driving reference pulse signal 27, to generate the output of abnormality signal 32. Further, in this embodiment, the abnormality signal 32 is adapted to be sent to the input of a relay driving circuit 33, generated as the output of an alarm signal 34 transmitted to an operator.

Figure 8:
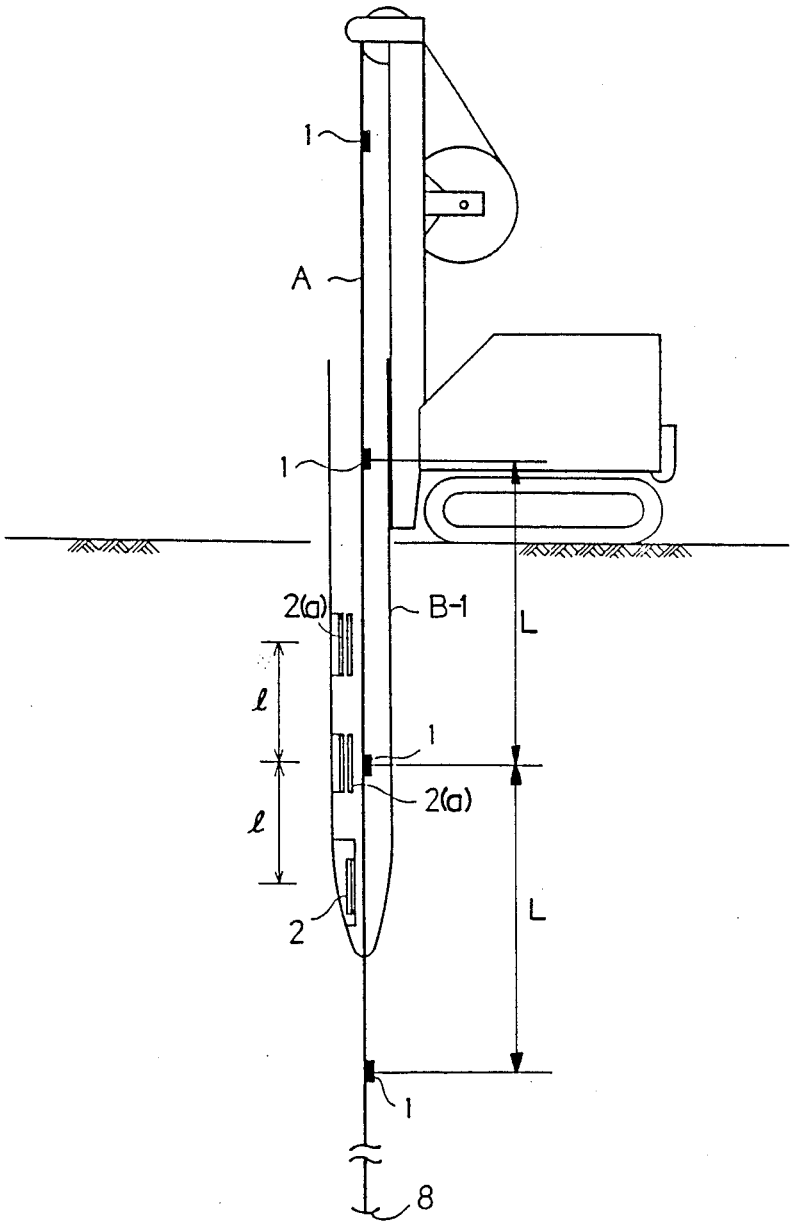
FIG. 8 is an embodiment of the invention showing still another preferred embodiment of the drain embedding mandrel.

Referring to FIG. 8, detectable elements are mounted on the drain material A at predetermined intervals L, while a plurality of sensing coils 2(*a*) connected to the recorder or the like are provided in the mandrel B-1 at predetermined intervals. As the mandrel B is withdrawn, the respective sensing coils 2(*a*) sequentially detect the respective detectable elements 1 to determine the vertical position of the drain material.

Figure 9:
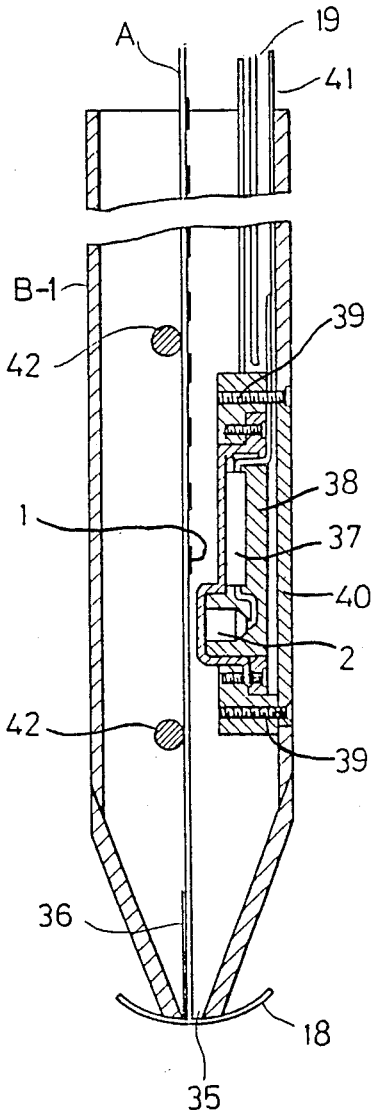
FIG. 9 is a fragmentary, elevational view in section of a mandrel lower end similar to the mandrel shown in FIG. 6.

FIG. 9 illustrates in greater detail the embodiment of the mandrel B-1 first shown in FIG. 6. This mandrel is cylindrical and has the tapered lower end provided with an opening 35. A shank 36 of the anchor 18 is inserted into the opening 35 and secured to the lower end of the drain material A. The anchor 18 is formed of a gently curved plastic or metal plate.

On the inner peripheral surface of the lower end of mandrel B-1 is mounted the sensor 2. Sensor 2 is sealingly received in a case 38, together with a controller 37, which is secured to mandrel B-1 with threaded fasteners 39,39. A portion of mandrel B-1 behind said case 38 is provided with an inspection window cover plate 40, also secured to mandrel B-1 with threaded fasteners 39,39. The cable 19, withdrawn through the controller 37, is encased in protective conduit 41. The drain material A inserted in the central portion in the mandrel B-1 is provided with the detectable elements 1 on the surface adjacent to the detector 2. Guide members 42,42 extend diametrally through the mandrel B to contact with the back side of the drain material A.

Figure 10:
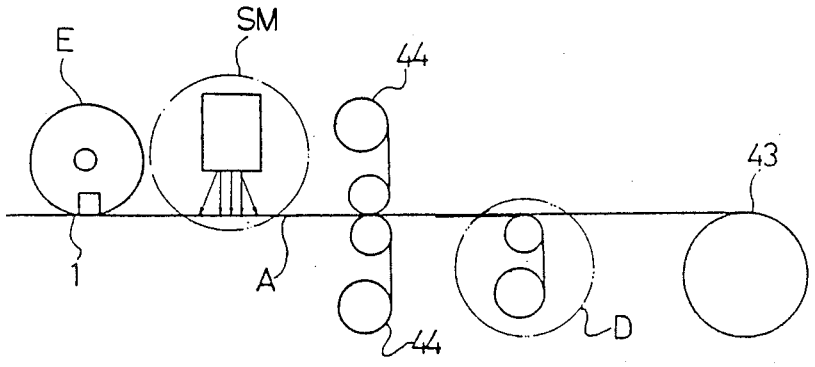
FIG. 10 is a schematic elevational view of preferred apparatus for applying detectable means to paper drain material.

FIG. 10 is a schematic representation of apparatus for applying magnetized detectable means 1 to one surface of the drain means A.

The paper drain A comprises an inner layer 43 and a pair of outer filter layers 44,44 sandwiching inner layer 43. Outer layers 44,44 are sprayed with magnetic substance by spray means S. Thereafter, the magnetic substances are magnetized by a magnetizing unit E to form the detectable means 1.

Thus, the present invention is well adapted to carry-out the objects and attain the ends and advantages mentioned above, as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

We claim:

1. The combination of a vertical paper drain, means for vertically embedding the paper drain in soil and means to detect whether the paper drain has been properly embedded in said soil, comprising: detectable elements secured to and longitudinally spaced apart on said paper drain; anchor means on the lower portion of said vertical paper drain; a vertical mandrel having a lower paper drain embedding end adapted to embed a vertical paper drain a predetermined distance in soil; sensing means secured to the said lower end of said mandrel adapted to sense said detectable elements and to generate a signal responsive to the detection of a detectable element; means to vertically withdraw said mandrel after said paper drain has been embedded a predetermined distance in soil; and means to receive and to display signals generated by said sensing means as it is moved vertically upward past said detectable elements.

2. The apparatus of claim 1, wherein each detectable element is adapted to modulate a signal so as to be distinguishable from the signal modulated by at least one other detectable element.

3. The apparatus of claim 1, wherein each detectable element is adapted to modulate a signal distinguishable from the signals modulated by every other detectable element.

4. The apparatus of claim 1, wherein the said lower end of said mandrel is adapted to accommodate the lower portion of said vertical paper drain to be releasably wrapped thereabout, wherein said lower end of said mandrel may be withdrawn from the portion of the paper drain wrapped thereabout, and whereby said paper drain wrapped-about portion is embedded in the soil to anchor the lower end of said paper drain.

5. The apparatus of claim 3, wherein said wrapped-about portion is shaped to form an anchor fluke.

6. The apparatus of claim 3, wherein said wrapped-about portion is hook-shaped to form an anchor fluke.

7. The method of embedding a paper drain in soil, comprising the steps of:

(a) securing longitudinally spaced-apart detectable substances on the paper drain;
(b) securing a sensing means to the lower end of a vertically aligned mandrel and adapting said sensing means to sequentially sense each of said paper drain detectable substances when said sensing means is positioned within a predetermined proximity of each of said detectable substances;
(c) securing an end portion of said paper drain to said lower end of said mandrel;
(d) driving said mandrel and said paper drain a predetermined distance into the soil;
(e) energizing said sensing means;
(f) separating said mandrel from said paper drain by vertically shifting said mandrel upwardly; and
(g) monitoring the signals emitted by said sensing means responsive to moving said sensing means within predetermined proximities of said detectable substances.

8. In combination with a vertical paper drain and a mandrel used to carry and then permanently insert the paper drain into soil, an electronic device for detecting relative movement between the drain and the mandrel as the mandrel is withdrawn from the soil subsequent to said insertion, comprising:

a plurality of electrically detectable means affixed to and located in spaced relation at regular intervals along a length of the paper drain;

a sensor means mounted and fixed to the mandrel wherein, upon withdrawal of the mandrel, the sensor passes by each of the electrically detectable means, the sensor means providing a first electrical signal indicative of its passing by each of the detectable means; and monitor means provided with said first signal wherein a user can determine from the monitor means the relative movement between the paper drain and the withdrawing mandrel.

9. An electronic device according to claim 8, including means for providing a second electrical signal indicative of relative movement between the mandrel and the soil, the said second signal being also provided to the said monitor means wherein the relative movement between the paper drain and the mandrel and the relative movement between the mandrel and the soil can be compared to each other by the user.

10. An electronic device according to claim 9, including a comparator means having a first input, a second input, and an output, the first signal indicative of relative movement between the paper drain and the mandrel being supplied to the first input, the second signal indicative of the relative movement between the mandrel and the soil being supplied to the second input, the output of the comparator providing a third electrical signal indicative of any differences between the relative movement of the mandrel to both the paper drain and soil.

11. An eletronic device according to claim 10, wherein said first and second signals represent respectively the rates of movement between the mandrel and the paper drain and the mandrel and the soil, the said third signal at the output of the comparator constituting an error signals when the said rates of movement are not equal to each other by a predetermined degree.

12. An electronic device according to claim 8, wherein the first electrical signal includes information for identifying which one of the detectable means the mandrel is then passing by or has just passsed by so that the location of the withdrawing mandrel relative to the paper drain can be determined.

13. An electronic device according to claim 12, wherein the electrical parameters of each detectable means are different so that the sensor provides a unique output signal for each detectable means it passes, the plurality of output signals constituting the said first signal.

* * * * *